US010487642B2

(12) United States Patent
Haci et al.

(10) Patent No.: US 10,487,642 B2
(45) Date of Patent: Nov. 26, 2019

(54) FREQUENCY ANALYSIS OF DRILLING SIGNALS

(71) Applicant: Schlumberger Technology Corporation, Sugar Land, TX (US)

(72) Inventors: Marc Haci, Houston, TX (US); Arturo Quezada, Pasadena, TX (US); Maurice Ringer, Lamorlaye (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 163 days.

(21) Appl. No.: 15/033,022

(22) PCT Filed: Oct. 27, 2014

(86) PCT No.: PCT/US2014/062355

§ 371 (c)(1),
(2) Date: Apr. 28, 2016

(87) PCT Pub. No.: WO2015/065883

PCT Pub. Date: May 7, 2015

(65) Prior Publication Data

US 2016/0245067 A1 Aug. 25, 2016

Related U.S. Application Data

(60) Provisional application No. 61/896,542, filed on Oct. 28, 2013.

(51) Int. Cl.

| | |
|---|---|
| ***E21B 47/00*** | (2012.01) |
| ***E21B 47/02*** | (2006.01) |
| ***E21B 7/04*** | (2006.01) |
| ***E21B 7/06*** | (2006.01) |
| ***E21B 3/00*** | (2006.01) |
| ***E21B 3/02*** | (2006.01) |

(Continued)

(52) U.S. Cl.

CPC ..... *E21B 47/0006* (2013.01); *E21B 3/00* (2013.01); *E21B 3/02* (2013.01); *E21B 7/04* (2013.01); *E21B 7/062* (2013.01); *E21B 44/04* (2013.01); *E21B 47/02* (2013.01); *E21B 4/02* (2013.01)

(58) Field of Classification Search

CPC ..... E21B 3/00; E21B 3/02; E21B 7/062
See application file for complete search history.

(56) References Cited

U.S. PATENT DOCUMENTS 6,802,378 B2 10/2004 Haci et al.
6,918,453 B2 7/2005 Haci et al.
(Continued)

FOREIGN PATENT DOCUMENTS

WO 2015065883 A1 5/2015

OTHER PUBLICATIONS

International Search Report and the Written Opinion for International Application No. PCT/US2014/062355 dated Feb. 3, 2015.

*Primary Examiner* — David J Bagnell
*Assistant Examiner* — Manuel C Portocarrero

(57) ABSTRACT

A method for directional drilling a subterranean borehole includes transforming surface sensor measurements from time domain sensor data to frequency domain sensor data. A rotary drilling parameter may be changed when a parameter of the frequency domain sensor data reaches a threshold or is within a predetermined range of values.

17 Claims, 3 Drawing Sheets

(51) Int. Cl.
*E21B 44/04* (2006.01)
*E21B 4/02* (2006.01)

(56) References Cited

U.S. PATENT DOCUMENTS

| | | | | |
|---|---|---|---|---|
| 7,096,979 | B2 | 8/2006 | Haci et al. | |
| 7,810,584 | B2 | 10/2010 | Haci et al. | |
| 2008/0204270 | A1 | 8/2008 | Aiello et al. | |
| 2009/0078462 | A1 | 3/2009 | Boone et al. | |
| 2009/0166031 | A1 | 7/2009 | Hernandez | |
| 2012/0255776 | A1* | 10/2012 | Knudsen | E21B 21/08 175/25 |
| 2012/0267169 | A1 | 10/2012 | Schwefe | |
| 2013/0032401 | A1* | 2/2013 | Edbury | E21B 7/06 175/24 |
| 2013/0245950 | A1 | 9/2013 | Jain et al. | |

* cited by examiner

FREQUENCY ANALYSIS OF DRILLING SIGNALS

CROSS REFERENCE TO RELATED APPLICATIONS

This application claims priority to and the benefit of U.S. Provisional Patent Application No. 61/896,542, filed 28 Oct. 2013, which is incorporated by reference herein.

BACKGROUND

Drilling and completing oil and gas wells are highly expensive undertakings as oil and gas bearing formations are generally located many thousand of feet below the surface of the earth. Since the cost of drilling a well is strongly time dependent, the faster the drilling operation is completed, the lower the cost in drilling the well.

Directional drilling techniques are widely known in the drilling industry for drilling oil and gas wells. One commonly used technique uses a hydraulically powered drilling motor to rotate a drill bit. The hydraulic power is provided by drilling fluid pumped down through the drill string from the surface. A "steerable" motor housing commonly includes a small angle bend along its axis (e.g., from about 0.5 to about 3 degrees). The direction of drilling may be controlled by selecting the drilling mode and the tool face angle of the bent housing. In the "rotary drilling" mode, the drill string is rotated at the surface such that the drilling motor rotates with the drill string. Rotary drilling is intended to maintain the current drilling direction (e.g., along the present inclination and azimuth). In "slide drilling" mode, the drill string is not rotated at the surface. Slide drilling is intended to change the drilling direction (i.e., to turn the wellbore) towards the tool face angle of the bent housing.

While such techniques have been commercially serviceable for many years, there are several drawbacks. For example, the toolface angle of the bent housing is commonly communicated to the surface via a low bandwidth mud pulse telemetry signal. Adjusting the toolface angle can therefore be a highly time consuming process. Moreover, slide drilling can be particularly problematic (especially in deep wells) due to static frictional forces between the drill string and the borehole wall. These frictional forces can make it difficult to adjust the toolface angle and to maintain weight on bit during drilling.

SUMMARY

A disclosed method for directional drilling a subterranean borehole includes receiving surface sensor measurements while rotary drilling the borehole. The received surface sensor measurements are transformed from time domain sensor data to frequency domain sensor data. A rotary drilling parameter may be changed when a parameter of the frequency domain sensor data reaches a threshold or is within a predetermined range of values. The surface sensor measurements may include, for example, surface torque measurements, axial load measurements, and standpipe drilling fluid pressure measurements. Rotary drilling parameters that may be changed in response to the frequency domain sensor data may include, for example, a rotation rate of the drill string, a weight on bit, and a drilling fluid flow rate.

The disclosed embodiments may provide various technical advantages. For example, one or more of the disclosed methods may provide a technique for directional drilling without the use (and therefore the accompanying drawbacks) of slide drilling. Certain disclosed methods may therefore reduce the time required to drill a well and thereby further reduce costs.

Moreover, obtaining frequency domain sensor data tends to provide a reliable triggering mechanism for changes in rotary drilling parameters during directional drilling operations, thereby providing more reliable directional control. The disclosed methods may generally be implemented using instrumentation readily available on most drilling rigs and tend to advantageously provide additional actionable information to the drilling operator. Furthermore, one or more disclosed methods may enable damaging axial vibrations to be identified and mitigated in a timely manner while drilling. The method may further advantageously make use of surface measurements, thereby eliminating the time delay related to transmitting downhole measurements to the surface.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
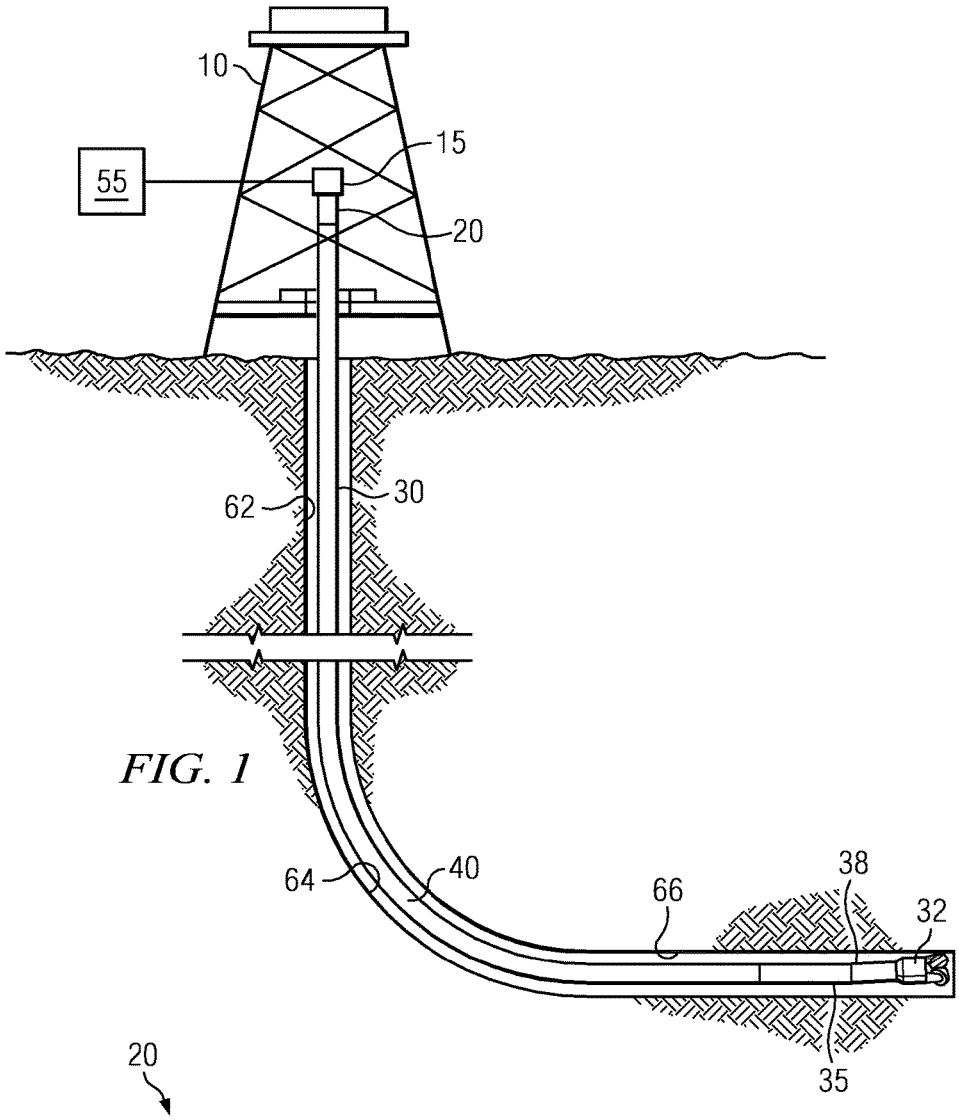
FIG. 1 depicts one example of a conventional drilling rig on which disclosed methods may be utilized.

FIG. 1 depicts a drilling rig 10 suitable for use with the disclosed method embodiments. A drilling platform is positioned in the vicinity of an oil or gas formation (not shown). The drilling rig 10 includes a derrick and a hoisting apparatus for raising and lowering various assemblies, for example, drill string 30, which, as shown, is deployed in borehole 40. The drilling rig 10 typically further includes a top drive 15 (or other suitable assembly such as a rotary table) rotatably connected to the drill string 30. The top drive 15 may be configured to rotate the drill string 30 in either direction (clockwise or counterclockwise).

In the depicted embodiment, drill string 30 includes a drill bit 32 and a hydraulically powered drilling motor 35. While not shown in detail on FIG. 1, it will be understood that the drilling motor 35 may include a housing (or a sub) having an axial bend 38 (e.g., in a range from about 0.5 to 3 degrees). Drill string 30 may further include a downhole telemetry system, one or more MWD or LWD tools including various sensors for sensing downhole characteristics of the borehole and the surrounding formation, and various other downhole tools. The disclosed embodiments are not limited in these regards.

In FIG. 1, borehole 40 is a deviated borehole including vertical 62, doglegged 64, and horizontal 66 sections. While not limited in this regard, the disclosed method embodiments tend to be well suited for drilling deviated boreholes (such as that depicted). It will also be understood by those skilled in the art that the disclosed embodiments are not limited to use with a land drilling rig 10 as illustrated in FIG. 1, but tend to be equally well suited for use with any kind of subterranean drilling operations, either offshore or onshore.

FIG. 1 further depicts one or more sensors 20 that are configured to provide measurements, for example, of the torque and axial load applied to the drill string 30. While these sensors 20 are depicted as being deployed in a "sub" located between drill string 30 and top drive 15, it will be understood that such a depiction is for illustration convenience only. The sensors 20 can be located at substantially any suitable rig or top drive location. It will be understood that one or more of the sensors 20 may be deployed within the drill string 30, for example, in close proximity to the drill bit 32. The sensors 20 may be further, although not necessarily, electronically connected to a control module 55, which is configured to control the top drive 15 and therefore the rotation applied to the drill string 30 during a drilling operation.

Figure 2:
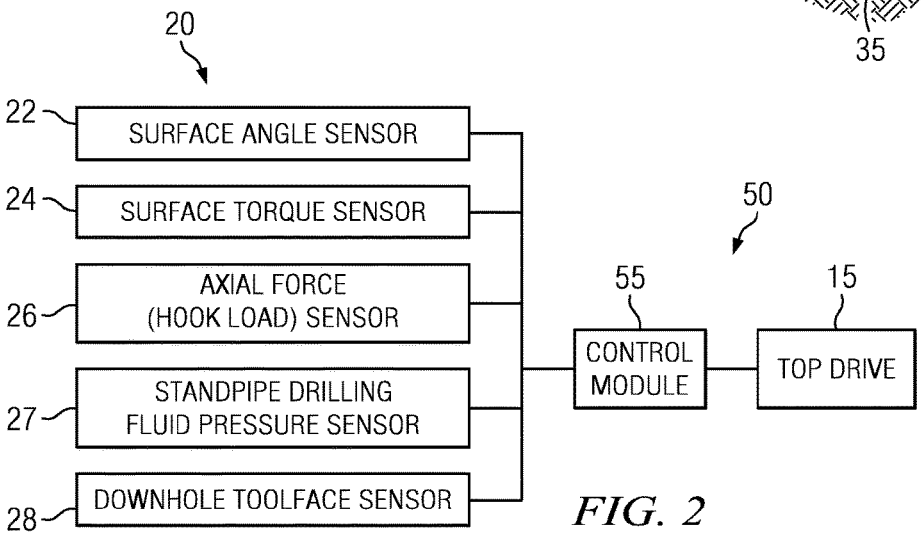
FIG. 2 depicts one example of a control system for executing method embodiments disclosed herein.

FIG. 2 depicts one example of a suitable system 50 for executing method embodiments disclosed herein. In the depicted example, system 50 includes at least one sensor 20. The system 50 may include substantially any number of sensors 20, for example, including a surface angle sensor 22, a surface torque sensor 24, a surface axial force or load (hook load) sensor 26, and a standpipe drilling fluid pressure sensor 27. The system 50 may further include a downhole tool face sensor 28 (e.g., an accelerometer set and/or a magnetometer set) for measuring the toolface angle of the bent sub in drilling motor 35 (FIG. 1). Those skilled in the art will also understand that surface torque sensor 24 need not directly measure the applied torque. For example, a "torque" sensor may measure the electrical current drawn by an electrical motor that operates the top drive 15 or a hydraulic pressure applied to a hydraulic motor that operates the top drive 15. The torque sensor may also be implemented as a strain gage on drill string (i.e., interconnected sections of drill pipe) 30 or on the shaft of top drive 15.

As stated above, one or more of the sensors 20 may be deployed in electronic communication with control module 55 (which may include, for example, a conventional computer or computerized system). The control module 55 may be in further communication with top drive 15 (or some other mechanism configured to rotate the drill string) and is typically configured to control the rotation of the top drive 15. In other configurations, the sensors 20 may be connected directly to a rig control system which may in turn be connected with control module 55. While FIG. 2 depicts a system suitable for automated control, it will be understood that the disclosed embodiments are not limited in this regard. Disclosed embodiments may likewise employ manual control schemes.

Figure 3:
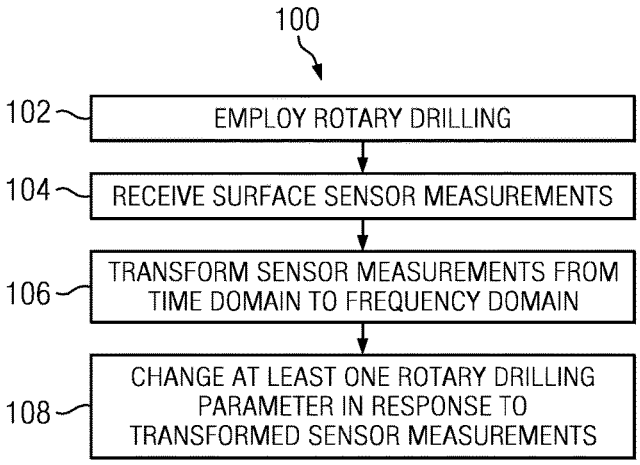
FIG. 3 depicts a flow chart of one disclosed method embodiment.

FIG. 3 depicts a flow chart of one example of a method 100 for directional drilling a subterranean borehole (e.g., as depicted on FIG. 1). At 102, a rotary drilling technique is used to drill the subterranean borehole. Those skilled in the art will readily appreciate that rotary drilling typically includes, as shown in FIG. 1, circulating drilling fluid through the drill string 30, rotating the drill string 30 at the surface using a top drive 15, rotary table, or other suitable drilling rig equipment, and advancing the drill string 30 into the borehole 40 as required by the rate of penetration of the subterranean formation. In embodiments that make use of a drilling motor 35, circulating drilling fluid through the drill string 30 causes the drill bit 32 to rotate relative to the drill string 30.

Sensor measurements are received at 104 while rotary drilling at 102. The sensor measurements may include surface sensor measurements, such as surface torque measurements, axial force (hook load) measurements, and/or standpipe pressure measurements. The received sensor measurements are transformed from the time domain to a frequency domain at 106 to obtain frequency domain sensor data from which various parameters may be evaluated. The frequency domain sensor data may include, for example, amplitude and/or phase content as a function of frequency as is described in more detail below with respect to FIGS. 6A, 6B, and 6C. Blocks of sensor data may be transformed at substantially any suitable time interval during drilling (e.g., at 10 second intervals). One or more of the rotary drilling parameters may be changed at 108 in response to the frequency domain sensor data, for example, when one or more parameters of the frequency domain sensor data reaches a threshold or falls within a predetermined range of values. Rotary drilling parameters that may be changed may include, for example, the rotation rate of the drill string, the axial load (weight on bit), and/or the drilling fluid flow rate.

Figure 4:
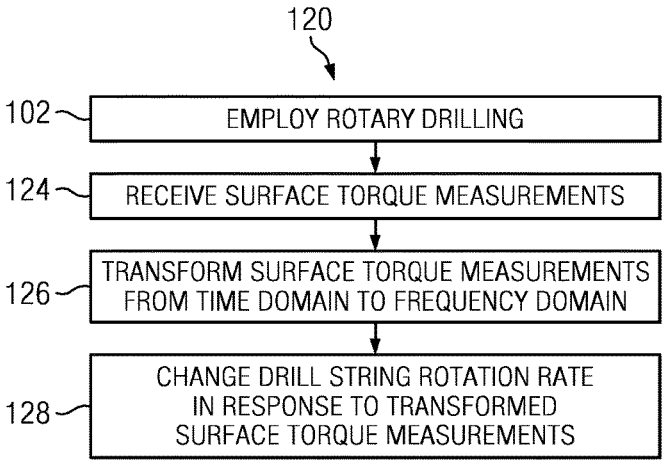
FIG. 4 depicts a flow chart of another disclosed method embodiment.

FIG. 4 depicts a flow chart of another example of a method 120 for directional drilling a subterranean borehole. Method 120 is similar to method 100 in that at 102 a rotary drilling technique is used to drill the subterranean borehole. At 124, surface torque measurements are received while rotary drilling at 102. The received surface torque measurements are transformed from the time domain to a frequency domain at 126 to obtain frequency domain surface torque data. The frequency domain rotary torque data may include, for example, amplitude and/or phase as a function of frequency as is described in more detail below with respect to FIGS. 6A, 6B, and 6C. The rotation rate of the drill string may be changed at 128 (while rotary drilling continues) in response to the frequency domain torque data, for example, when one or more parameters of the frequency domain torque data reaches a threshold or falls within a predetermined range of values. For example, upon reaching a predetermined phase at a particular frequency, the rotation rate and/or direction may be changed (e.g., decreased) as is described in more detail below.

Method 120 may be utilized to directionally drill a subterranean borehole while continuously rotary drilling (i.e., without slide drilling). For example, the drill string rotation rate may be alternated back and forth between a first high rotation rate and a second low rotation rate. The drill string may be rotated at the high rotation rate when one of the parameters (e.g., the phase) of the frequency domain rotary torque data is in a first predetermined range of values and at the low rotation rate when the parameter is a second predetermined range of values. Alternatively, the drill string may be rotated at the low rotation rate when the parameter is in a predetermined range of values and at the high rotation rate when the parameter is outside the predetermined range of values. In one such embodiment, the drill string may be rotated at the low rotation rate when the phase at a particular frequency is within a predetermined range of values (e.g., within a range of about 90 degrees). Since the phase may be correlated with the tool face angle of the bent sub, alternating back and forth between the high and low rotation rates enables the drill string to spend more time rotary drilling the borehole within a predetermined range of toolface angles thereby causing the drilling direction to turn in that direction.

Figure 5:
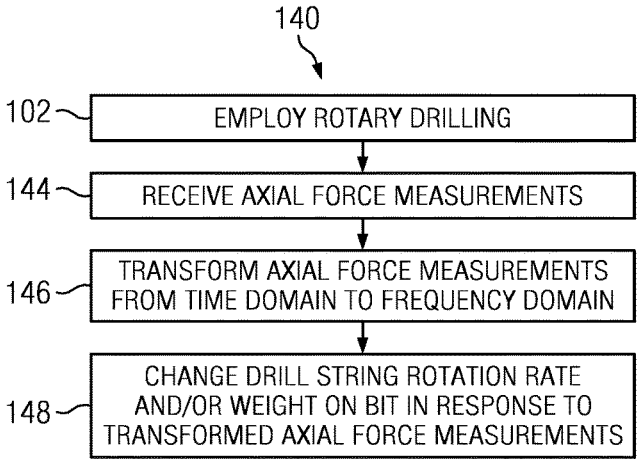
FIG. 5 depicts a flow chart of still another disclosed method embodiment.

FIG. 5 depicts a flow chart of another example of a method 140 for directional drilling a subterranean borehole. Method 140 is similar to method 100 in that at 102 a rotary drilling technique is used to drill the subterranean borehole. At 144, axial load (hook load) measurements are received while rotary drilling at 102. Frequency analysis techniques are applied at 146 to the axial load measurements received at 144 to obtain frequency domain axial load data. The frequency domain axial load data may include, for example, amplitude and/or phase as a function of frequency as is described in more detail below with respect to FIGS. 6A, 6B, and 6C. The rotation rate of the drill string or the weight on bit may be changed at 148 in response to the frequency domain axial load data, for example, when one or more parameters of the frequency domain axial load data reaches a threshold or falls within a predetermined range of values.

For example, an increasing amplitude of the axial force at a particular frequency or within a range of frequencies may indicate the onset of damaging axial vibration modes (sometimes referred to in the art as 'bit bounce'). When the amplitude exceeds a predetermined value within a predetermined frequency range (indicative of high amplitude bit bounce), mitigating actions may be triggered, for example, decreasing the weight on bit or increasing the rotation rate of the drill string. Those skilled in the art will be aware of and readily able to implement various other mitigating actions.

Figure 6A:
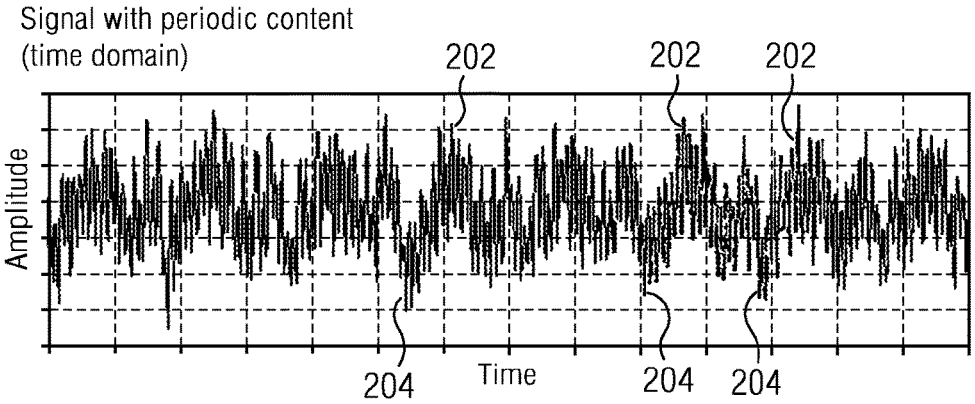
FIG. 6A depicts a plot of applied surface torque versus time for a directional drilling operation.

FIG. 6A depicts a plot of surface torque amplitude versus time for a rotary drilling operation. Note that the torque amplitude required to rotate the drill string at a constant rotation rate changes approximately periodically (e.g., maxima and minima are depicted at 202 and 204). Analysis of this periodic behavior may enable the frequency and phase information of the torque oscillations to be correlated with the angular position and rotational speed of the drill string. For example, the main frequency may be correlated with the rotation rate of the drill string while the maxima and minima may be correlated with particular toolface angles. Other related phenomena, such as stick-slip, may also be observed and interpreted via analyzing the torque oscillations.

The frequency and phase content of the torque amplitude data (e.g., as shown on FIG. 6A) may be obtained via various frequency analysis techniques. For example, Fourier, Laplace, and/or Z-transforms may be utilized to convert the torque amplitude data from a time domain signal to a frequency domain signal. Other frequency analysis methodologies may include, for example, peak detection using derivatives, filtering phase extraction, or maximum and minimum calculations within a data window. The disclosed embodiments are not limited to any particular frequency analysis technique.

Figure 6B:
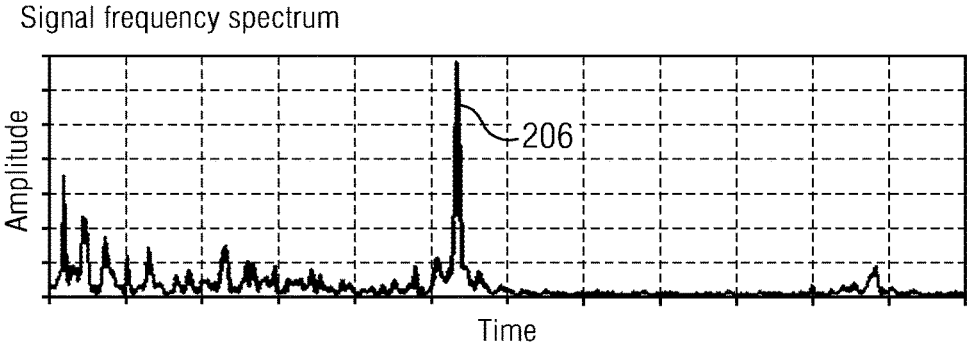
FIG. 6B depicts a plot of amplitude versus frequency as obtained via applying a Fast Fourier Transform to the data shown on FIG. 6A.
Figure 6C:
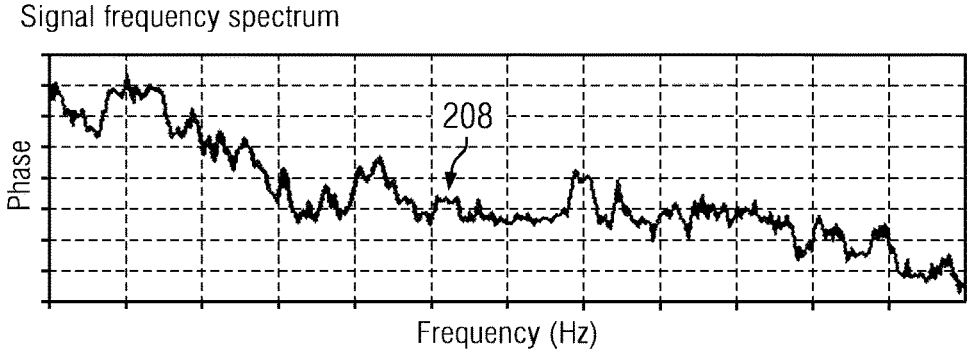
FIG. 6C depicts a plot of phase versus frequency as obtained via applying a Fast Fourier Transform to the data shown on FIG. 6A

FIG. 6B depicts a plot of surface torque amplitude versus frequency obtained via applying a Fast Fourier Transform (FFT) to the data shown on FIG. 6A. FIG. 6C depicts a plot of phase versus frequency obtained by applying a FFT to the data shown on FIG. 6A. Frequencies of interest may indicate the rotational speed of the drill string in the borehole. For example, a drill string rotation rate of 180 RPM may yield an amplitude peak at a frequency of about 3 Hz. Various harmonics and other oscillations may also be observed and may be indicative of various drilling string vibrational modes. One such amplitude peak is shown at 206 on FIG. 6B. The phase extracted at a particular frequency of interest may be correlated with the toolface angle of the bent sub and thereby provide the angular position reference required for triggering a change in rotation drilling rotation rates (one such phase is indicated at 208 on FIG. 6C). For example, the phase angle may be correlated with downhole toolface measurements at various intervals along the measured depth of the borehole.

Although methods for directional drilling a subterranean borehole and certain advantages thereof have been described in detail, it should be understood that various changes, substitutions and alternations can be made herein without departing from the spirit and scope of the disclosure.

What is claimed is:

1. A method for directional drilling a subterranean borehole, the method comprising:

(a) causing a top drive to continuously rotate a drill string to rotary drill the subterranean borehole;

(b) causing a surface sensor to make corresponding sensor measurements while continuously rotating the drill string in (a);

(c) transforming the surface sensor measurements from time domain sensor data to frequency domain sensor data; and (d) automatically changing at least one of a drill string rotation rate or a weight on bit, in (a) when a parameter of the frequency domain sensor data reaches a threshold or is within a predetermined range of values;

wherein the surface sensor is electronically connected to a control module which is configured to automatically cause the top drive to change the rotation rate of the drill string in (d) or to automatically change the weight on bit in (d).

2. The method of claim 1, wherein said rotary drilling in (a) comprises:

(i) deploying a drilling string in the borehole, the drill string including a plurality of interconnected sections of drill pipe and a bottom hole assembly including a drilling motor and a drill bit, the drilling motor including a bent housing along its axis;

(ii) circulating drilling fluid through the drill string thereby causing the drilling motor to rotate the drill bit relative to the drill string; and (iii) causing the top drive to continuously rotate the drill string to drill the subterranean borehole.

3. The method of claim 1, wherein the sensor measurements comprise at least one of surface torque measurements or axial force measurements.

4. The method of claim 1, wherein the sensor measurements are transformed in (c) using at least one of a Fourier transform, a Laplace transform, or a Z-transform.

5. The method of claim 1, wherein the parameter of the frequency domain sensor data comprises at least one of an amplitude or a phase at a particular frequency.

6. The method of claim 1, wherein the surface sensor measurements comprise surface torque measurements and (d) comprises changing the drill string rotation rate.

7. The method of claim 1, wherein the surface sensor measurements comprise axial force measurements and (d) comprises changing at least one of the drill string rotation rate or the weight on bit.

8. A method for directional drilling a subterranean borehole, the method comprising:

(a) deploying a drilling string in the borehole, the drill string including a plurality of interconnected sections of drill pipe and a bottom hole assembly including a drilling motor and a drill bit, the drilling motor including a bent housing along its axis;

(b) circulating drilling fluid through the drill string thereby causing the drilling motor to rotate the drill bit relative to the drill string;

(c) continuously rotary drilling the borehole via causing a top drive to rotate the drill string from a surface location;

(d) causing a surface torque sensor to make measurements of the surface torque applied to the drill string while rotary drilling in (c);

(e) transforming said surface torque measurements from time domain torque data to a frequency domain torque data; and (f) causing the top drive to change a rotation rate of the drill string of said continuous rotary drilling in (c) when a parameter of the frequency domain torque data reaches a threshold or is within a predetermined range of values, wherein the surface torque sensor is electronically connected to a control module which is configured to automatically cause the top drive to change the rotation rate in (f).

9. The method of claim 8, wherein said surface torque measurements are transformed in (e) using at least one of a Fourier transform, a Laplace transform, or a Z-transform.

10. The method of claim 8, wherein the parameter of the frequency domain torque data comprises at least one of an amplitude or a phase at a particular frequency.

11. The method of claim 10, wherein the top drive rotates the drill string at a first high rotation rate in (f) when the phase at the particular frequency is in a first predetermined range of values and the top drive rotates the drill string at a second low rotation rate in (f) when the phase at the particular frequency is in a second predetermined range of values.

12. The method of claim 10, wherein the top drive rotates the drill string at a first high rotation rate in (f) when the phase at the particular frequency is outside of a predetermined range of values and the top drive rotates the drill string at a second low rotation rate in (f) when the phase at the particular frequency is inside the predetermined range of values.

13. A method for directional drilling a subterranean borehole, the method comprising:

(a) deploying a drilling string in the borehole, the drill string including a plurality of interconnected sections of drill pipe and a bottom hole assembly including a drilling motor and a drill bit, the drilling motor including a bent housing along its axis;

(b) circulating drilling fluid through the drill string thereby causing the drilling motor to rotate the drill bit relative to the drill string;

(c) continuously rotary drilling the borehole via causing a top drive to rotate the drill string from a surface location;

(d) causing a surface torque sensor to make measurements of the surface torque applied to the drill string while rotary drilling in (c);

(e) transforming said surface torque measurements from a time domain to a frequency domain to obtain a phase at a particular frequency; and (f) causing the top drive to alternate back and forth between a first high drill string rotation rate and a second low drill string rotation rate while continuously rotary drilling in (c), the top drive rotating the drill string at the first rotation rate when the phase is within a first predetermined range of values and the top drive rotating the drill string at the second rotation rate when the phase is within a second predetermined range of values, wherein surface torque sensor is electronically connected to a control module which is configured to automatically cause the top drive to alternate back and forth between the first high drill string rotation rate and the second low drill string rotation rate in (f).

14. The method of claim 13, wherein:

the drill string further comprises a tool face sensor configured to measure a toolface angle of the bent housing;

(c) further comprises causing the tool face sensor to measure the tool face angle of the bent housing; and (f) further comprises correlating the phase at the particular frequency with the toolface angle of the bent housing measured in (c) such that causing the top drive to alternate back and forth between a first high drill string rotation rate and a second low drill string rotation rate in (f) enables the drill string to spend more time rotary drilling the borehole within a predetermined range of toolface angles thereby causing a direction of drilling to turn.

15. The method of claim 13, wherein said surface torque measurements are transformed in (e) using a Fast Fourier Transform.

16. A method for directional drilling a subterranean borehole, the method comprising:

(a) deploying a drilling string in the borehole, the drill string including a plurality of interconnected sections of drill pipe and a bottom hole assembly including a drilling motor and a drill bit, the drilling motor including a bent housing along its axis;

(b) circulating drilling fluid through the drill string thereby causing the drilling motor to rotate the drill bit relative to the drill string;

(c) continuously rotary drilling the borehole via causing a top drive to rotate the drill string from a surface location;

(d) causing a hook load sensor to make measurements of an axial load applied to the drill string while rotary drilling in (c);

(e) transforming the axial load measurements from time domain axial force data to frequency domain axial force data; and (f) causing a top drive to change a rotation rate of the drill string in (c) when at least one parameter of the frequency domain axial force data reaches a threshold or is within a predetermined range of values or changing a weight on bit while continuously rotating in (c) when the at least one parameter of the frequency domain axial force data reaches the threshold or is within the predetermined range of values, wherein the hook load sensor is electronically connected to a control module which is configured to automatically cause the top drive to change the rotation rate of the drill bit in (f) or to automatically change the weight on bit in (f).

17. The method of claim 16, wherein the at least one parameter of the frequency domain axial force data includes an amplitude of the axial force, and wherein the axial force exceeds a predetermined threshold within a predetermined range of frequencies.

* * * * *